US005421251A

United States Patent [19]

Bruke

[11] Patent Number: 5,421,251

[45] Date of Patent: Jun. 6, 1995

[54] APPARATUS FOR COMPACTING MATERIAL

[75] Inventor: Richard L. Bruke, Bunkeflostrand, Sweden

[73] Assignee: Spirac Engineering AB, Malmo, Sweden

[21] Appl. No.: 273,268

[22] Filed: Jul. 11, 1994

Related U.S. Application Data

[63] Continuation-in-part of Ser. No. 70,454, filed as PCT/SE 92/CO 802, Nov. 19, 1992, abandoned.

[30] Foreign Application Priority Data

Nov. 19, 1991 [SE] Sweden ..... 9103451

[51] Int. Cl.[6] ..... B30B 9/16

[52] U.S. Cl. ..... 100/117; 100/127; 100/146; 100/148

[58] Field of Search ..... 100/41, 117, 126, 127, 100/145-150; 366/320

[56] References Cited

U.S. PATENT DOCUMENTS

| | | | |
|---|---|---|---|
| 128,288 | 6/1872 | Damant | 366/320 X |
| 1,847,690 | 3/1932 | Hottmann | 100/149 X |
| 2,143,304 | 1/1939 | Doering | 100/150 X |
| 3,222,853 | 12/1965 | Michael | 100/145 X |
| 4,227,451 | 10/1980 | Slavinsky | 100/148 X |
| 4,303,010 | 12/1981 | Coffey | 100/145 X |
| 4,498,382 | 2/1985 | Pera et al. | 100/117 |
| 4,779,528 | 10/1988 | Bruke | 100/148 X |

FOREIGN PATENT DOCUMENTS

| | | | |
|---|---|---|---|
| 0009850 | 4/1980 | European Pat. Off. | 100/148 |
| 0179842 | 5/1986 | European Pat. Off. . | |
| 2258259 | 8/1975 | France . | |
| 2462263 | 2/1981 | France . | |
| 604239 | 10/1934 | Germany . | |
| 8401063 | 11/1985 | Netherlands | 100/145 |
| 274052 | 6/1951 | Switzerland . | |

*Primary Examiner*—Stephen F. Gerrity
*Attorney, Agent, or Firm*—Ladas & Parry

[57] ABSTRACT

The disclosure relates to an apparatus (1) and a method for compacting material, in which the apparatus comprises a path (10), an infeed device (40) which discharges in an opening (11) disposed in the path, and a spiral (30) which is rotary about its longitudinal axis and has no mechanical shaft. In connection with the discharge opening (12) of the apparatus, baffles (13) are provided which impede displacement of the material, Between the free end (39) of the spiral and the discharge opening (12) of the apparatus, the casing forms a compaction cell (15). The spiral is disposed to at least intermittantly abut against the path, in addition to which the spiral and the path form, in the region of the opening (11), a feed compartment (35) for supplied material, this compartment directly merging into the compaction cell (15).

35 Claims, 7 Drawing Sheets

APPARATUS FOR COMPACTING MATERIAL

This is a application Ser. No. 08/070,454, filed on Jun. 8, 1993, (abandoned) and International Application PCT/SE 92/00802, filed on Nov. 19, 1992, and which designated the U.S.

FIELD OF THE INVENTION

The present invention relates to an apparatus for receiving and compacting material.

BACKGROUND ART

There is a need in this art to be able to compact material which includes components of various sizes, densities, elasticity, moisture content etc. Material of the type mentioned by way of introduction is often massive and bulky and needs to be compressed or compacted in order to be capable of being handled and transported in an economically viable manner Such needs occur, for example, in industrial operations and in municipal waste disposal, for example in refuse collection. For wet matter, it is also often desirable to reduce the moisture content of the material in connection with its compression (compaction).

Prior art technology calls for the employment of hydraulic compactors for compacting material of the above-disclosed type. Hydraulic compactors are expensive, unwieldly and heavy, in addition to which the reduction in volume which is obtained is relatively slight. As regards, for example, domestic or commercial waste, the reduction involved is no greater than a factor of 3. This slight degree of compaction is because all material to be found in the transport container is compacted at the same time.

For compaction purposes, use is also made of screw compactors consisting of a mechanical shaft which is fitted with thread blades and is surrounded by a tubular casing. Compaction is achieved in that the screw compactor presses the material into a container which is filled in due course. When the container has been filled, the screw compactor is employed to continue to force material into the container and there is thereby obtained a certain degree of compression of the material which is located in the container. However, the level of compaction is relatively slight; nor does this technique exceed a level of compaction of a factor 3. The explanation for the slight degree of compaction is that those pressure forces which are exercised by the screw compactor are absorbed by substantially all material located in the container, with the result that those forces which act on each individual component will, naturally be relatively slight. Screw compactors have relatively low capacity in relation to their size, suffer from difficulties in handling large objects and require considerable power for their operation. In addition, screw compactors are large and heavy, as well as being expensive in both purchase and operation.

Spiral compactors are also employed for compacting material. The term spiral compactor is here taken to signify compactors including a spiral which is rotary about its longitudinal axis, which lacks a mechanical shaft and which includes a spiral or helical blade stood on its end and surrounded by a casing. In such instance, the spiral and the casing form a precompaction zone where compaction of the material commences. In the precompaction zone the spiral has an outer diameter which is slightly less than the inner diameter of the casing. Thereby, the spiral closely approaches (with slight clearance) the surrounding casing. The precompaction zone is followed, in the direction of displacement of the material, by a region which has no spiral and in which the final compaction of the material takes place.

Spiral compactors have a relatively simple design and construction which results in low practical and running costs, at the same time as the degree of compaction is considerably better than the above-disclosed factor of 3. The construction of spiral compactors described in the preceding paragraph (slight clearance between casing and spiral) entails, however, the disadvantage that, on varying material size, the material is occasionally jammed between the spiral and the casing. In particular when large-pieces of material are involved, blockages readily occur, with resultant operational disturbance or operational disruption.

OBJECT OF THE INVENTION

The present invention has for its object to devise a spiral compactor in which the above-disclosed drawbacks are obviated and in which the advantages afforded by the spiral compactor are attained.

SUMMARY OF THE INVENTION

This object is attained by a construction in which a feed compartment of the spiral compactor directly merges into a compaction cell of the compactor.

BRIEF DESCRIPTION OF THE ACCOMPANYING DRAWINGS

The present invention will now be described in greater detail hereinbelow, with particular reference to the accompanying drawings. In the accompanying drawings.

Figure 1:
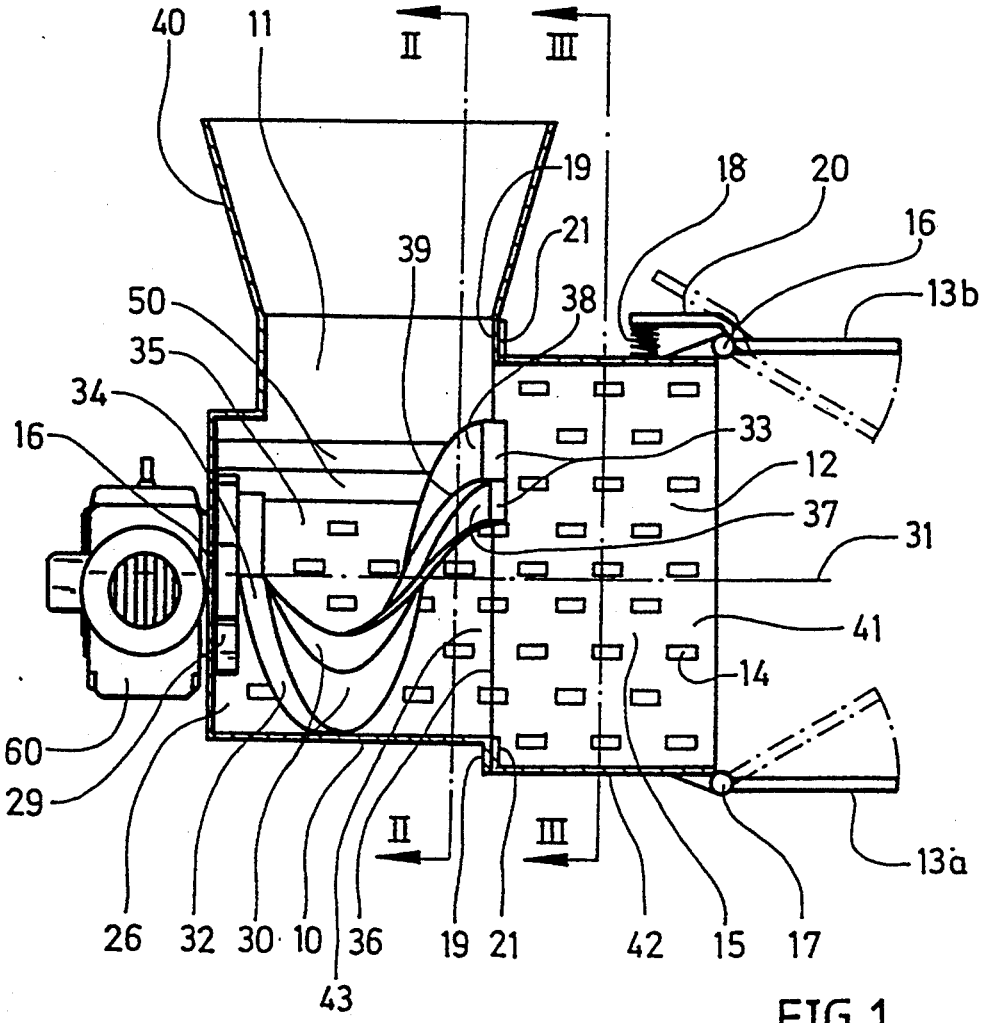
FIG. 1 shows a portion of one embodiment of a spiral compactor provided with a single spiral.
Figure 2:
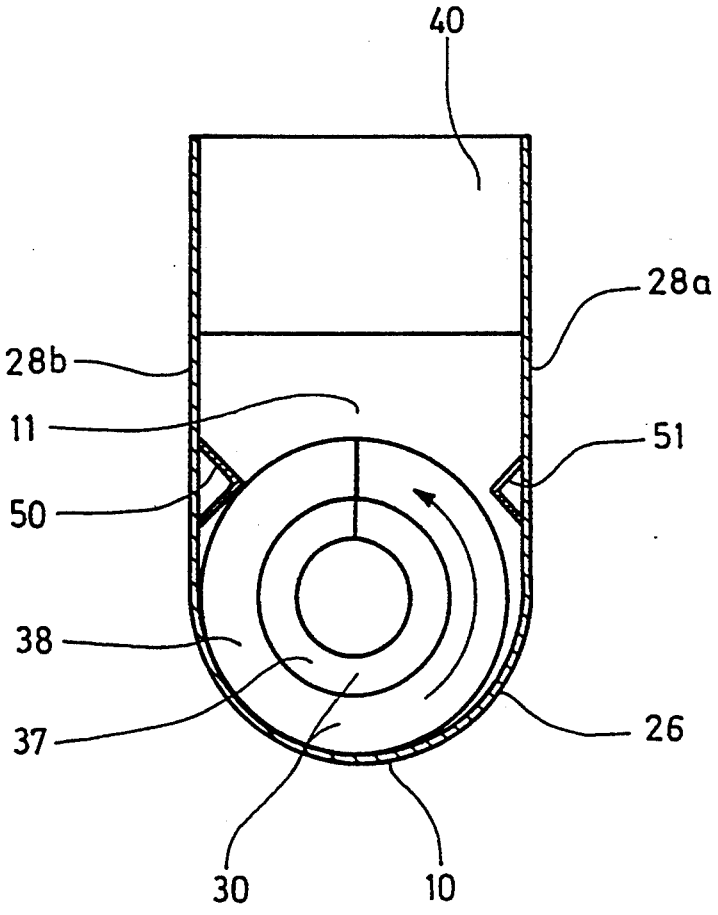
FIG. 2 is a section taken along the line II—II in FIG. 1.
Figure 2A:
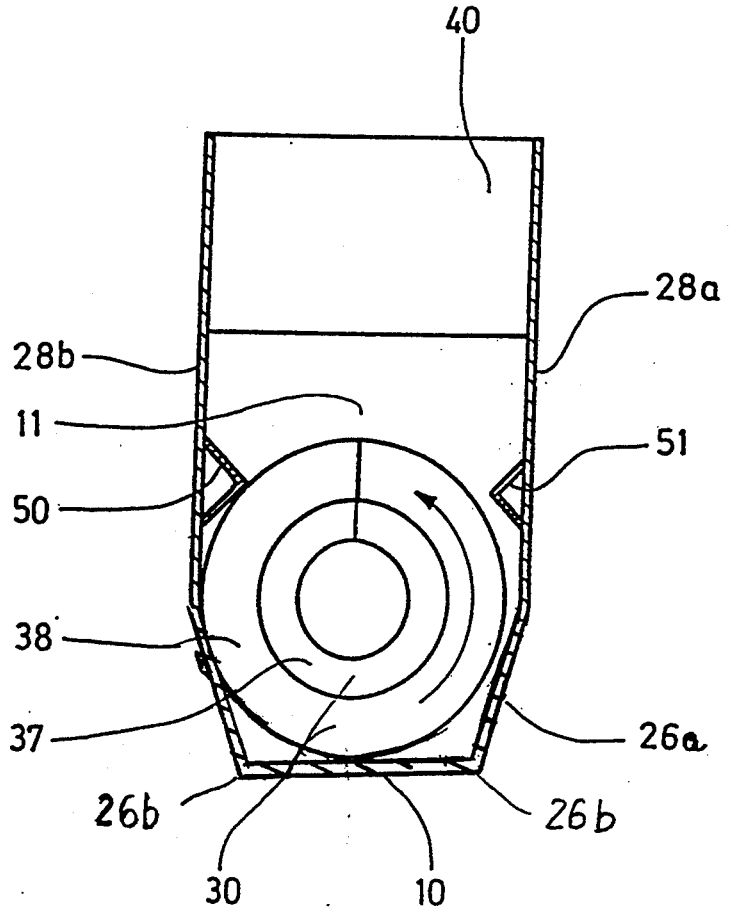
Figure 3:
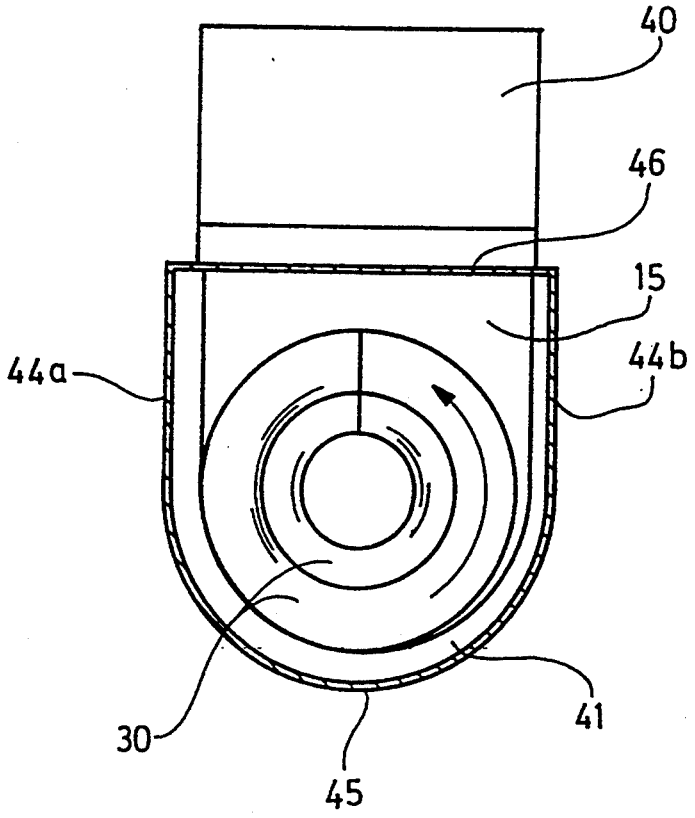
Figure 4:
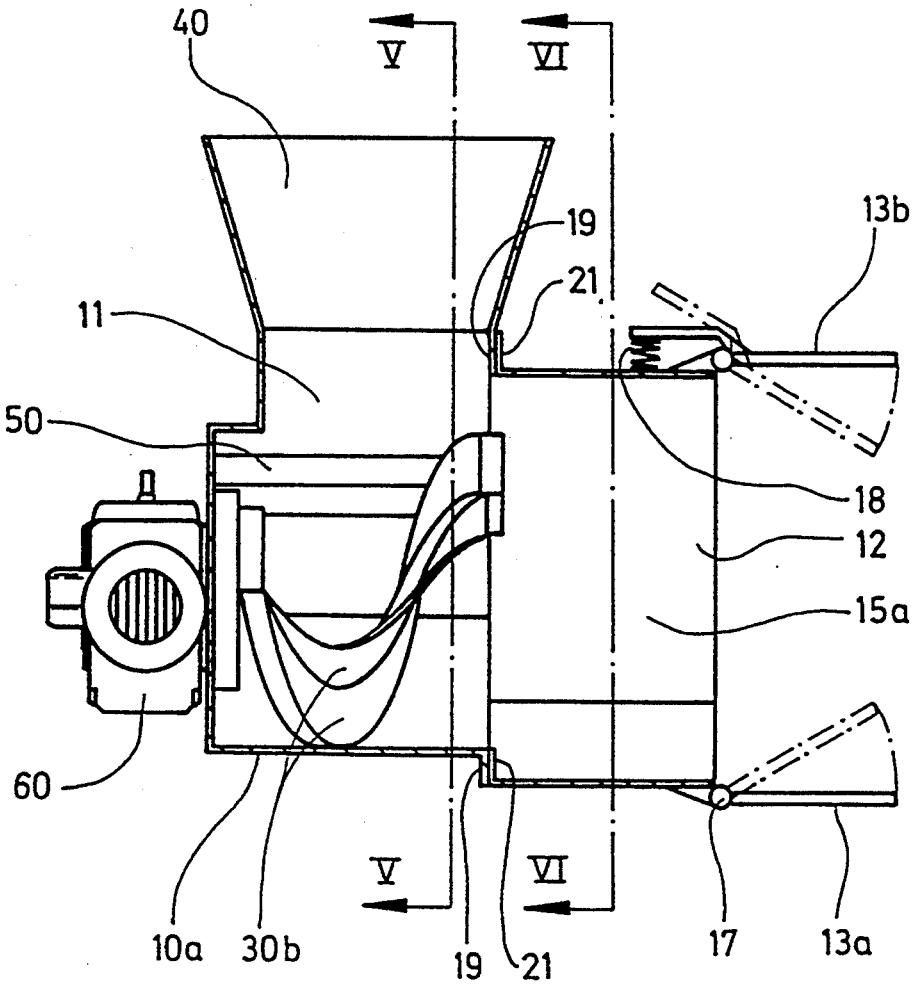
Figure 5:
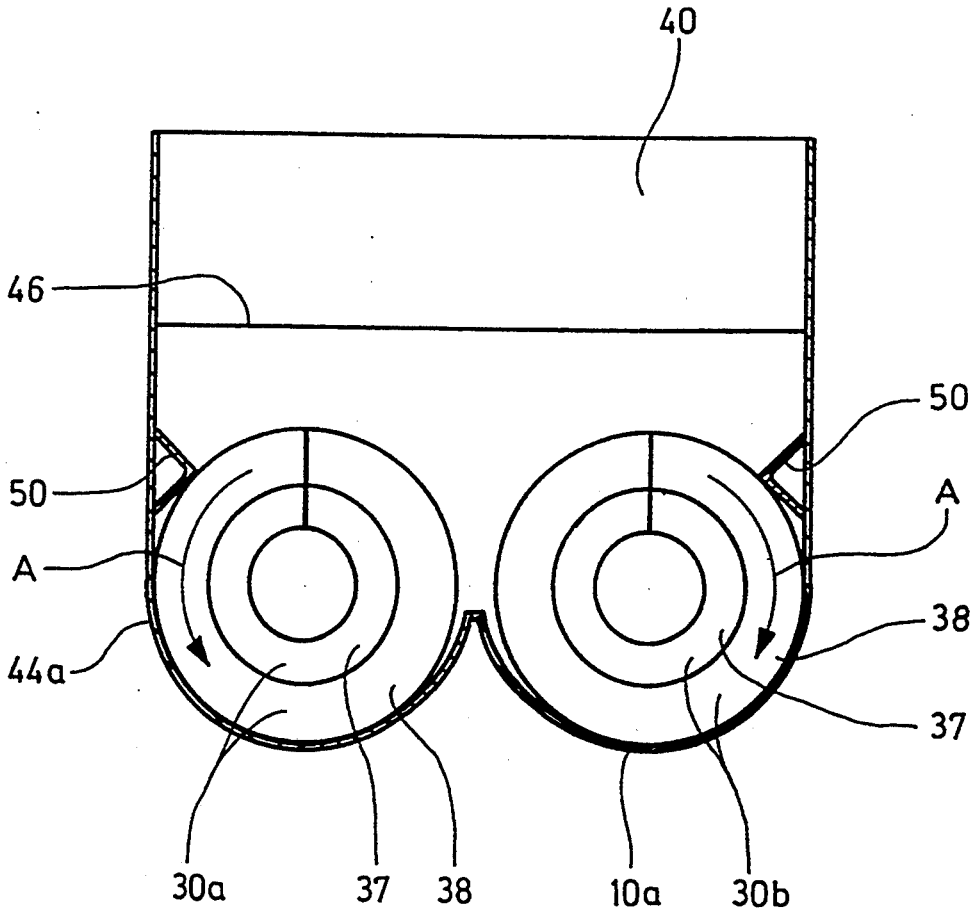

FIG. 2*a* shows a modified section of FIG. 2;

FIG. 3 is a section taken along the line II—III in FIG. 1;

FIG. 4 shows another embodiment of a portion spiral compactor with two spirals;

FIG. 5 is a section taken along the line V—V in FIG. 4; and

Figure 6:
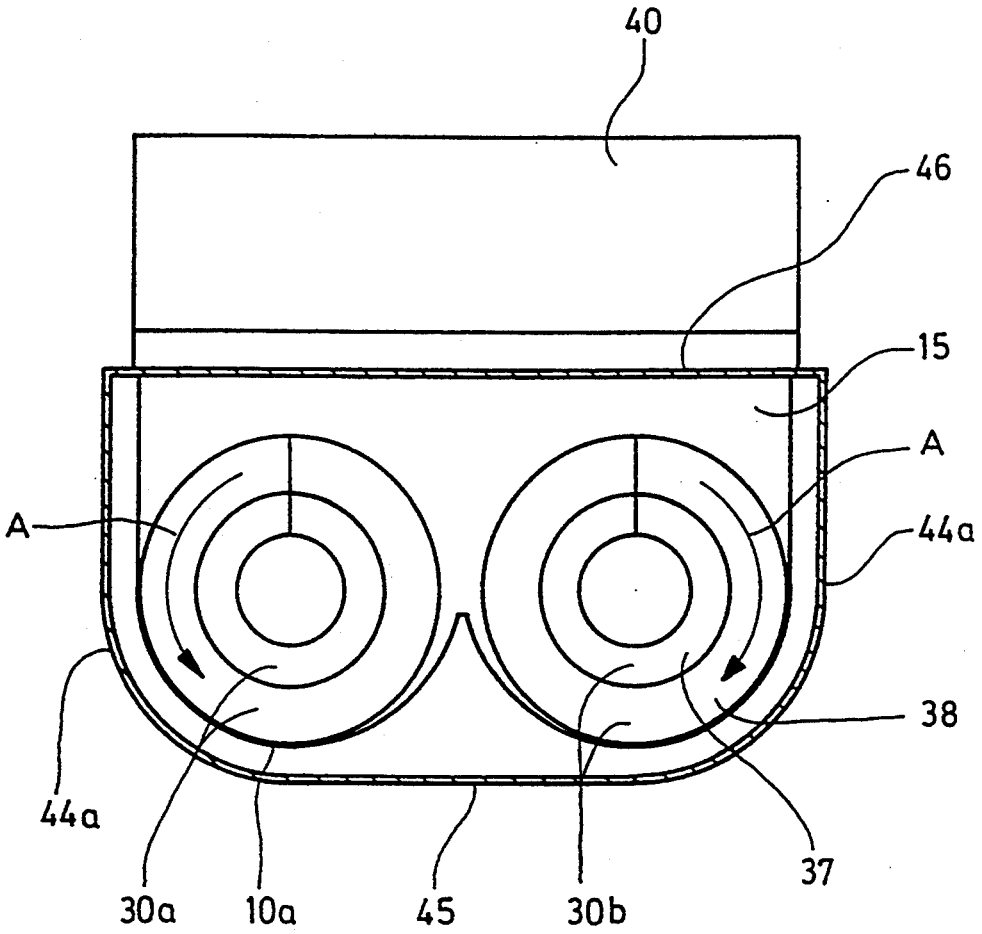

FIG. 6 is a section taken along the line VI—VI in FIG. 4.

DETAILED DESCRIPTION OF PREFERRED EMBODIMENT

FIGS. 1–3 show one embodiment of an apparatus according to the present invention including a spiral 30 which is placed in path 10. The spiral is rotary about its geometric centre axis 31. The path has a lower portion 26 which is of a cross-section entailing that the lower region surrounds the spiral with relatively slight clearance. In the embodiment illustrated in FIG. 2, the cross-section of the lower portion is semicircular, in addition to which the lower portion merges into two substantially upstanding walls 28*a, b,* which form the upper portion 27 of the path. The one end 34 of the spiral, its driving end, is connected, via a journal 16 in the one end, the drive end of the path 10, to drive means 60 for rotating the spiral. The spiral 30 includes a spiral blade 33 which is stood on its end and is, in the illustrated embodiment, composed of an inner part spiral blade 37 and an outer part spiral blade 38 connected with the inner part spiral blade. The arrows in FIGS. 2 and 3 indicate the direction of rotation of the spiral.

The spiral blade 33 is journalled only in connection with its drive means 60, while its other end 39 is non-journalled. Hereinafter, the non-journalled end will generally be designated the free end 39 of the spiral blade or the spiral. The free end 39 is located in or adjacent to the discharge end 43 of the path 10. The journal 16 is placed such that the spiral blade 33 rotates, most proximal the journal 16, without any mechanical contact with the lower portion 26 of the path or with the upwardly directed walls 28*a,b* of the path. On rotation, the spiral is disposed, with the exception of its portion located most proximally the journal, to abut with its outer defining edge 32, against the lower portion 26 of the path 10. However, as a rule the spiral blade abuts against only a limited region of the lower portion of the path, defined as that region of the lower portion with which the spiral blade 33 during rotation progressively alters its direction of movement from being substantially vertical to being substantially horizontal. This side of the path against which the spiral substantially abuts will hereafter be designated the support side. It is clear that, on rotation of the spiral blade, material particles are often entrained between the path and the defining edge and also often form a thin layer of material between the spiral blade and the path. As a result, in operation, abutment between the spiral blade and the path is intermittent. However, for the sake of simplicity it will hereinafter be disclosed that the spiral blade abuts against the path or is supported by the path 10 irrespective of whether the spiral blade 33 is in direct contact with the path or in contact via a material layer located between the spiral blade and the path. In order to achieve the sought-for abutment against the path, the journal 16 and the spiral blade 33 are, as a rule, designed so as, on heavy loading, to allow the spiral to be resiliently displaced in a radial direction.

On abutment of the spiral 30 against the path 10, the outer defining edge 32 of the spiral is substantially parallel with the inner defining surface of the path. As a result of the elasticity of the spiral in the radial direction, the spiral will, on rotation, progressively abut with its outer defining edge 32 against the path along the greater portion of the length of the spiral according as the abutment surface moves in the longitudinal direction of the path. Hereby, wear of the inside of the path will not be concentrated at a restricted area, as would be the case if the spiral had been radially rigid. A spiral supported by a central mechanical shaft entails such a "concentrated" wear if the spiral abuts against the path in its end regions.

An infeed device 40, shown in FIG. 1 as a hopper-like device, connects to an opening 11 provided in the path 10, the infeed opening of the path. In the longitudinal direction of the path the infeed opening 11 is of a length which essentially corresponds to the entire length of the spiral 30. The spiral and the path form, in this region, a feed compartment 35 for the supplied material. In one preferred embodiment, the diameter and pitch of the spiral are then adapted such that the spiral has substantially but one spiral turn. Between the infeed opening 11 of the path and the discharge opening 12 of the apparatus, there is disposed a chamber 41 surrounded by a casing 42 in the circumferential direction. That part of the space which is located between the free end 39 of the spiral and the discharge opening 12 of the path forms a space which, hereinafter, will generally be designated the compaction cell of the apparatus. The compaction cell normally consists of a part of the chamber 41, but in certain embodiments a part of the feed compartment 35 is also included in the compaction cell. With the exception of the dimensions, the cross-sectional configuration of the compaction cell is optional. It may, for example be circular, oval, include curved portions, be polygonal etc. FIG. 2*a* shows a polygonal shape of the lower portion 26*a* of the casing. The polygonal portion forms corner 26*b* which prevent the material from rotating circumferentially.

The free end 39 of the spiral is disposed in the region of the transition 36 between the opening 11 and the compaction cell 15. The intention here, in certain embodiments, is to project the spiral a short distance into the chamber 41, at most approximately half of the length of the chamber and, as a rule, at most approximately one third of the length of the chamber. In another embodiment, the free end 39 of the spiral is located in the region of a plane transversely of the axial direction of the spiral path the bounding definition of the infeed opening 11, most proximal the discharge opening 12. In a third embodiment, the spiral terminates ahead of the above-mentioned plane and at a distance therefrom corresponding to at most one third of a thread pitch, as a rule at most a quarter of a thread pitch.

The chamber 41 surrounded by the casing 42 is dimensioned so as to eliminate the risk of jamming of material which is fed into the chamber. This is achieved in that the chamber 41 is given a larger cross-section than the feed compartment 35. Primarily the upper bounding definition 46 of the chamber is raised in relation to the corresponding part of the feed compartment. As a rule, the side definitions 44*a,b* and lower definition 45 of the chamber are also placed at a greater distance from the geometric centre line 31 continuing from the spiral 30 than corresponding parts of the feed compartment in relation to the centre line. To this end, in certain embodiments the transition between the feed compartment and the chamber forms a step, while in other embodiments the transition diverges continually. There are also embodiments in which the step is substantially replaced by the chamber 41 continually flaring towards the discharge opening 12 of the chamber (the apparatus). However, in this latter case, the upper bounding definition of the chamber is, as a rule, raised in comparison with the corresponding portion of the feed compartment. In certain embodiments, the chamber is provided with substantially continually tapering cross-sectional area after the step.

In connection with the discharge opening 12 of the casing there is disposed a baffle member 13*a,b* which prevents displacement of the material. The baffle members are designed to assume a position which does not prevent displacment of the material for a pressure loading which exceeds a certain value. In FIG. 1 examples of alternative embodiments of the baffle member are shown in which these are journalled in the outer edge of the opening 12.

In the lower region of FIG. 1, there is shown a baffle member 13*a* which is connected to the opening 12 of the compaction cell 15 in a journal 17. This is designed as a hinge with a built-in return spring, i.e. a spring which returns the baffle member to its starting position when the baffle member is not under the influence of external forces. The hinge is provided with means for adjusting the size of that force with which the integral spring of the hinge acts on the baffle member.

In the upper portion of FIG. 1 there is shown an embodiment in which baffle member 13*b* is journalled in a journal 16. The baffle member is provided with one or more projecting portions 20 which, via one or more spring members 18, hold the baffle member in the position illustrated in the FIG.. By modifying the distance between the journal 16 and the anchorage point of the spring member 18 in each respective projecting portion 20, that force which is required for moving aside the baffle member 13*b* from the starting position of the member is regulated. It will be obvious to a person skilled in the art that the baffle can be of any optional design and also be connected to any optional suitable, fixed portion of the apparatus. Similarly, means are provided in certain embodiments for pretensioning the spring members 18.

Two embodiments for returning the baffle members and for governing the force required for moving the baffle members in a direction away from the starting position of these members have been described above and shown in the Drawings. It will be obvious to the skilled reader that a corresponding function will also be achieved in other embodiments, for example employing pneumatically or hydraulically operating devices. It will likewise be obvious to a person skilled in the art that the positions of the journals 16 and 17 for the baffle members are selected in certain embodiments so that the journals are disposed within the compaction cell 15. In such instance, the baffle members are at least partly disposed within the path 10. In certain embodiments, the baffle members are designed as resiliently returning throttle cones.

At least one first mechanical guide member 50 is disposed substantially above the spiral 30 and in the region of the opening 11. The guide member is oriented in the longitudinal direction of the spiral and is of a length which substantially corresponds to the length of the infeed opening in the longitudinal direction of the spiral. It further applies according to the invention that the guide member is disposed on the support side of the path, i.e. on that side against which the spiral blade 33 is displaced in a radial direction on rotation of the spiral. The disclosed displacement in a radial direction depends upon the direction of rotation (right or left-hand turn) of the spiral and those reaction forces which occur between the spiral and the material displaced by the spiral. The guide member 50 is located closely adjacent to or abuts against the outer defining edge 32 of the spiral, at least when the spiral 30 rotates. The guide member also forms a scraper blade for material which accompanies the spiral on its rotation. In addition, the guide member prevents the spiral from being lifted up out of the path 10 as a result of upwardly directed forces which may occur on rotation of the spiral. In one preferred embodiment in which the apparatus includes one or more first guide members 50, the minimum distance between the first guide member and the opposing wall 28*a* of the opening is generally less than the diameter of the spiral. Also in this embodiment, it is ensured that the spiral remains in its path if the spiral were to be exposed to upwardly directed forces. As a rule, the first guide member 50 constitutes a sufficient obstacle preventing the spiral from being lifted up out of its path.

In certain embodiments, at least one supplementary mechanical guide member 51 (second guide member) is provided in the region of the opening 11. The supplementary guide member 51 is disposed on the opposite side of the opening 11 in relation to the previously mentioned (first) guide member 50. Generally, the second guide member is also of a length corresponding to the length of the first guide member and is oriented in the longitudinal direction of the spiral. The distance between the first guide member 50 and the second guide member 51 is less than the diameter of the spiral. It will hereby be ensured that the spiral is not lifted up out of its path as a result of possible upwardly directed forces which may occur in connection with rotation of the spiral.

In one preferred embodiment in which the apparatus is intended to compact moist material and, in such instance, reduce the moisture content in the material, the path 10 and/or the casing 42 is provided with drainage apertures 14 through which liquid pressed out of the material leaves the feed compartment 35 and/or the compaction cell 15. As a rule, drainage means 14, such as perforations, apertures etc, are provided in both the feed compartment and the compaction cell.

FIG. 1 also shows one embodiment of the present invention in which the compaction cell 15 accommodating the feed compartment 35 and the chamber 41 consists of two separate parts which are interconnected by means of connection devices 19 and 21, respectively. These are shown in the Figure as flange elements, but it will be obvious to a person skilled in the art that any appropriate design whatever of the connection devices may be employed without departing from the spirit and scope of the present invention.

In certain embodiments, the chamber 41 is connected to a container (not shown), in which event the compaction cell is, in certain practical applications, connected to the container in the region of the discharge opening of the compaction cell while, in other practical applications, the compaction cell is wholly or partly housed in the container.

The design of the feed compartment 35 and the compaction chamber 15 as two separate units also affords considerable freedom in the dimensioning of the feed compartment and compaction cell in dependence upon the relevant composition of the material which is to be handled by the apparatus. Thus, it applies that the length of the compaction cell is selected, for instance, depending upon the desired degree of compaction and/or total solids of the material once it has passed through the apparatus, or requisite friction to achieve a stable material plug in the compaction cell. The other dimensions involved may also be adapted in response to the relevant material type. Thus, the compaction cell is preferably given greater height and width than the feed compartment in the event of massive material pieces. Both the feed compartment 35 and the compaction cell 15 are given a cross-sectional configuration which is adapted to suit the relevant material type. Likewise, the clearance between the path and the spiral is dimensioned in view of the material which is to be handled.

FIGS. 4–6 show an embodiment of the present invention in which two mutually cooperating spirals 30*a,b* are provided for infeed of material to the compaction cell 15*a*. In this embodiment the apparatus is substantially constructed corresponding to that previously described with particular reference to FIGS. 1–3. For the sake of simplicity, the same reference numerals will be employed for the embodiment illustrated in FIG. 4 as those previously used for devices corresponding to previously described devices. The path 10 for each respective spiral is of a design corresponding to that disclosed above for previously described embodiments, entailing that, in those areas where the spiral normally abuts against the path 10 or, in certain operational cases is brought into abutment against the path, the minimum radius of curvature of the path corresponds substantially to or exceeds half of the outer diameter of each respective spiral. Even though the expression radius of curvature has been employed here, the described principle is also applicable when only portions of the path form supports which are discrete in the longitudinal direction. Drive means 60 impart to the spirals counter-directed rotation (cf. the arrows A), the direction of rotation being selected so that the material, on displacement towards the compaction cell 15*a*, will also show a tendency to be displaced towards the region between the two spirals. Hereby, material is accumulated in a central material strand which forces the spirals downwardly and assists in preventing the spirals from being raised up from the path 10*a*.

The Figures show one embodiment of the compaction cell 15 which is suited for use when the apparatus includes two mutually cooperating spirals 30. In such instance, the compaction cell 15 has, in the illustrated embodiment, a substantially planar upper bounding definition 46 and a substantially planar lower definition 45. The upper definition connects to the lower definition via bounding definitions 44*a,b* which, in their lower regions curve in towards the substantially planar lower definition 45.

In one preferred embodiment, the guiding of the rotation of the spirals is designed such that rotation is terminated by each respective spiral being set in a reception position in which that portion of the spiral blade which is located beneath the central region of the infeed opening is located adjacent to the lowermost part of each respective path. This disclosure also-applies to embodiments comprising but a single spiral.

When the apparatus according to the present invention is reduced to practice, material is supplied via the infeed device 40 and the infeed opening 11. The drive means 50 rotate the spiral 30 and this displaces material towards the discharge opening 12 of the casing. The baffle members 13 arrest the material in its displacement and a material plug of compacted material begins to be built up in the compaction cell 15,15*a*. New material which is fed in by the spiral is accumulated and compacted against the material plug and, when this has reached a certain length, it exercises such a pressure against the baffle members that these give way. However, movement of the material plug in the casing is still retarded by the friction between the casing, the baffle members and the material in the plug, at the same time as the spiral blade, at its free end, forces material towards the plug and thereby compacts the material. As new material is fed through the opening, material is accumulated and compacted against the plug and this is displaced out of the casing. On compaction of the material, extremely high compacting forces are achieved since the material is located in a restricted and small space and since the compressive forces applied against the material are concentrated in a very small surface area whose size is determined by the end portion of the spiral.

On rotation of the spiral, the guide member 50 (which closely approaches the spiral proper) prevents material from penetrating between the spiral and the path. On rotation of the spiral, material may occasionally adhere to the spiral blade but the guide member scrapes such material free from the spiral blade.

A compaction apparatus according to the present invention will be of considerably smaller dimensions and display a higher degree of compaction than a screw compactor of corresponding capacity, since the screw compactor has a "flow area" for the material which is determined by the height of the thread blade, while the spiral compactor has a "flow area" which is substantially determined by the diameter of the spiral. An increase in the transport area in the compaction cell 15 in relation to the feed compartment 35 will eliminate the clog risk which occurs in prior art spiral compactors. The compact construction makes it possible to install the spiral conveyor in areas where available space does not permit installation of spiral compactors according to prior art technology for the material which passes into the compaction cell.

The above detailed description has referred to but a limited number of embodiments of the present invention, but it will readily be perceived by a person skilled in this art that the present invention encompasses a large number of embodiments without departing from the spirit and scope of the appended claims.

I claim:

1. Apparatus for compacting material comprising:

a casing having an infeed opening for material to be compacted, a rotatable spiral in said casing having a longitudinal axis of rotation, said spiral comprising substantially a single spiral turn which lacks a mechanical shaft, drive means drivingly connected to one end of said spiral for rotating said spiral around said longitudinal axis of rotation, said spiral having an opposite end which is free and unsupported in said casing, said casing defining a feed compartment having a longitudinal length substantially equal to a longitudinal length of said infeed opening, said spiral having a longitudinal length substantially equal to the length of the feed compartment.

said casing further defining a compaction cell extending in longitudinal continuation of said feed compartment and directly merging therewith at a transition between said feed compartment and said compaction cell, said compaction cell having a discharge outlet spaced longitudinally from said transition, baffle means at said discharge outlet of said compaction cell for opposing displacement of said material and discharge thereof from said outlet, said casing having a boundary surface opposite said infeed opening adjoining a peripheral surface of said spiral.

2. Apparatus as claimed in claim 1, wherein said opposite free end of said spiral is disposed in the region of said transition between said feed compartment and said compaction cell.

3. Apparatus as claimed in claim 1, comprising a mechanical guide member on said casing in said feed compartment, said mechanical guide member being positioned on a side of said spiral opposite said boundary surface of said casing, said guide member being disposed on one side wall of said casing and spaced from an opposite side wall of said casing by a distance less than a diameter of said spiral.

4. Apparatus as claimed in claim 1, wherein said casing is provided with drainage apertures in at least one of said feed compartment and said compaction cell.

5. Apparatus as claimed in claim 1, wherein said casing includes separate portions constituting said compaction cell and said feed compartment and means connecting said portions together.

6. Apparatus as claimed in claim 1, comprising a second said spiral in said casing disposed parallel to the first said spiral and driven by said drive means in a direction opposite said first spiral such that material is carried by the first and second spirals towards a center of the casing.

7. Apparatus as claimed in claim 1, comprising adjustable elastic means acting on said baffle means for controlling a degree of opposition to the displacement of said material.

8. Apparatus as claimed in claim 1, wherein said compaction cell has a greater cross-sectional area than a cross-sectional area of the feed compartment.

9. Apparatus as claimed in claim 1, wherein said casing is substantially horizontal and includes opposite side walls which are vertical and spaced apart, said side walls in said feed compartment extending upwardly to open at an inlet hopper, said side walls in said compaction cell extending vertically and being closed by a flat, upper wall, said compaction cell having a length in the longitudinal direction which is less than the length of the feed compartment in the longitudinal direction.

10. Apparatus as claimed in claim 1, wherein said boundary surface of said casing is round and closely adjoins said peripheral of said spiral.

11. Apparatus as claimed in claim 1, wherein said boundary surface of said casing includes at least one corner.

12. Apparatus for compacting material comprising:

a casing having an infeed opening for material to be compacted, a rotatable shaftless spiral in said casing having a longitudinal axis of rotation, drive means drivingly connected to one end of said spiral for rotating said spiral around said longitudinal axis of rotation, said spiral having an opposite end which is free and unsupported in said casing, said casing defining a feed compartment having a longitudinal length substantially equal to a longitudinal length of said infeed opening, said casing further defining a compaction cell extending in longitudinal continuation of said feed compartment and directly merging therewith at a transition between said feed compartment and said compaction cell, said opposite free end of said spiral being disposed in the region of said transition between said feed compartment and said compaction cell, said compaction cell having a discharge outlet spaced longitudinally from said transition, and baffle means at said discharge outlet of said compaction cell for opposing displacement of said material and discharge thereof from said outlet.

13. Apparatus as claimed in claim 12, wherein said shaftless spiral has a longitudinal length substantially equal to the length of the feed compartment.

14. Apparatus as claimed in claim 12, wherein said shaftless spiral has a longitudinal length substantially equal to the length of said infeed opening.

15. Apparatus as claimed in claim 12, wherein said casing has a boundary surface opposite said infeed opening, said shaftless spiral having a periphery adjoining said boundary surface, said apparatus further comprising a mechanical guide member on said casing in said feed compartment, said mechanical guide member being positioned on a side of said shaftless spiral opposite said boundary surface of said casing, said guide member being disposed on one side wall of said casing and spaced from an opposite side wall of said casing by a distance less than a diameter of said spiral.

16. Apparatus as claimed in claim 12, wherein said casing is provided with drainage apertures in at least one of said feed compartment and said compaction cell.

17. Apparatus as claimed in claim 12, wherein said casing includes separate portions constituting said compaction cell and said feed compartment and means connecting said portions together.

18. Apparatus as claimed in claim 12, comprising a second said shaftless spiral in said casing disposed parallel to the first said shaftless spiral and driven by said drive means in a direction opposite said first shaftless spiral such that material is carried by the first and second shaftless spirals towards a center of the casing.

19. Apparatus as claimed in claim 12, comprising adjustable elastic means acting on said baffle means for controlling a degree of opposition to the displacement of said material.

20. Apparatus as claimed in claim 12, wherein said compaction cell has a greater cross-sectional area than a cross-sectional area of the feed compartment.

21. Apparatus as claimed in claim 12, wherein said casing is substantially horizontal and includes opposite side walls which are vertical and spaced apart, said side walls in said feed compartment extending upwardly to open at an inlet hopper, said side walls in said compaction cell extending vertically and being closed by a flat, upper wall, said compaction cell having a length in the longitudinal direction which is less than the length of the feed compartment in the longitudinal direction.

22. Apparatus as claimed in claim 12, wherein said boundary surface of said casing is round and closely adjoins said periphery of said spiral.

23. Apparatus as claimed in claim 12, wherein said boundary surface of said casing includes at least one corner.

24. Apparatus for compacting material comprising:

a casing having an infeed opening for material to be compacted, a rotatable shaftless spiral in said casing having a longitudinal axis of rotation, drive means drivingly connected to one end of said shaftless spiral for rotating said spiral around said longitudinal axis of rotation, said spiral having an opposite end which is free and unsupported in said casing, said casing defining a feed compartment having a longitudinal length substantially equal to a longitudinal length of said infeed opening, said casing further defining a compaction cell extending in longitudinal continuation of said feed compartment and directly merging therewith at a transition between said feed compartment and said compaction cell, said compaction cell having a discharge outlet spaced longitudinally from said transition, baffle means at said discharge outlet of said compaction cell for opposing displacement of said material and discharge thereof from said outlet, said casing having a boundary surface opposite said infeed opening, said shaftless spiral having a periphery adjoining said boundary surface, and said casing comprising a mechanical guide member in said feed compartment, said mechanical guide member being positioned on a side of said spiral opposite said round boundary surface of said casing.

25. Apparatus as claimed in claim 24, wherein said spiral has a longitudinal length substantially equal to the length of said infeed opening.

26. Apparatus as claimed in claim 25, wherein said spiral has a longitudinal length substantially equal to the length of the feed compartment.

27. Apparatus as claimed in claim 24, wherein said opposite free end of said spiral is disposed in the region of said transition between said feed compartment and said compaction cell.

28. Apparatus as claimed in claim 24, wherein said casing is provided with drainage apertures in at least one of said feed compartment and said compaction cell.

29. Apparatus as claimed in claim 24, wherein said casing includes separate portions constituting said compaction cell and said feed compartment and means connecting said portions together.

30. Apparatus as claimed in claim 24, comprising a second said shaftless spiral in said casing disposed parallel to the first said shaftless spiral and driven by said drive means in a direction opposite said first shaftless spiral such that material is carried by the first and second shaftless spirals towards a center of the casing.

31. Apparatus as claimed in 24, comprising adjustable elastic means acting on said baffle means for controlling a degree of opposition to the displacement of said material.

32. Apparatus as claimed in claim 24, wherein said compaction cell has a greater cross-sectional area than a cross-sectional area of the feed compartment.

33. Apparatus as claimed in claim 24, wherein said casing is substantially horizontal and includes opposite side walls which are vertical and spaced apart, said side walls in said feed compartment extending upwardly to open at an inlet hopper, said side walls in said compaction cell extending vertically and being closed by a flat, upper wall, said compaction cell having a length in the longitudinal direction which is less than the length of the feed compartment in the longitudinal direction.

34. Apparatus as claimed in claim 24, wherein said boundary surface of said casing is round and closely adjoins said periphery of said spiral.

35. Apparatus as claimed in claim 24, wherein said boundary surface of said casing includes at least one corner.

* * * * *